United States Patent [19]

Kandal

[11] Patent Number: 4,783,092

[45] Date of Patent: Nov. 8, 1988

[54] AMUSEMENT TOY CATCH DEVICE

[75] Inventor: Frederick S. Kandal, Columbia, Md.

[73] Assignee: Nuway Distributors, Inc., Baltimore, Md.

[21] Appl. No.: 87,886

[22] Filed: Aug. 21, 1987

[51] Int. Cl.[4] ..... A63B 67/10

[52] U.S. Cl. ..... 273/319; 273/412; 273/414

[58] Field of Search ..... 273/319, 320, 321, 412, 273/413, 414

[56] References Cited

U.S. PATENT DOCUMENTS

| | | | |
|---|---|---|---|
| 925,290 | 6/1909 | Carey | 273/320 |
| 2,616,698 | 11/1952 | Singer | 273/320 |
| 3,083,970 | 4/1963 | Schwartz | 273/319 |
| 3,717,341 | 2/1973 | Blanton, Jr. | 273/1 G |

FOREIGN PATENT DOCUMENTS

| | | | |
|---|---|---|---|
| 1381500 | 1/1975 | United Kingdom | 273/321 |

*Primary Examiner*—William H. Grieb

*Attorney, Agent, or Firm*—Birch, Stewart, Kolasch & Birch

[57] ABSTRACT

An amusement toy having a first elongated member with a first end and a second end. The second end is held by an individual's fingers for manipulation. A second elongated member includes a first end and a second end. The second end is held by an individual's fingers for manipulation. A catch object is provided having a predetermined size. A securing member is provided for securing the catch object at a predetermined distance from a first end of the first elongated member. Swinging the catch object about the first end of the first elongated member and manipulating the first and second elongated members to permit the first ends to touch each other, enables an individual to selectively capture the catch object between the first ends of the first and second elongated members.

4 Claims, 1 Drawing Sheet

AMUSEMENT TOY CATCH DEVICE

BACKGROUND OF THE INVENTION

1. Field of the Invention

The present invention is directed to an amusement toy wherein two elongated members are provided. A catch object is affixed to one end of one of the elongated members. By manipulating the elongated members, an individual can capture the catch object between the elongated members.

2. Description of Background Art

Individuals have utilized elongated members for assisting with regard to consuming food. It is customary in oriental restaurants to employ the use of chopsticks to assist with regard to the consumption of food products.

A movie film entitled *Karate Kid* included footage wherein an elderly gentleman attempted to capture a live fly by utilizing chopsticks. The attempts of the elderly gentleman were unsuccessful. The younger character in the movie was successful in capturing a fly by utilizing conventional chopsticks.

SUMMARY AND OBJECTS OF THE INVENTION

It is an object of the present invention to provide two elongated members adapted to be held by an individual's fingers for manipulation. A catch object is secured to one end of one of the elongated members. By manipulating the elongated members and swinging said catch object about said first end, an individual may capture the catch object between ends of the first and second elongated members.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
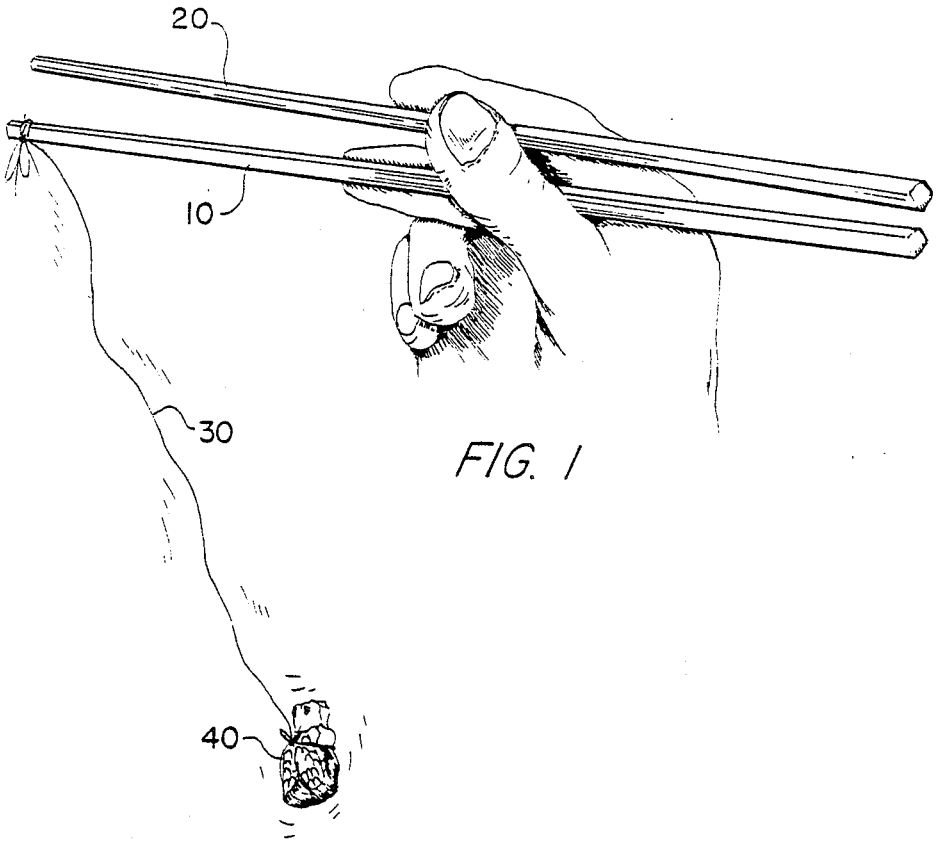
FIG. 1 is a perspective view illustrating the amusement toy of the present invention wherein the catch object is secured to a first end of an elongated member.
Figure 2:
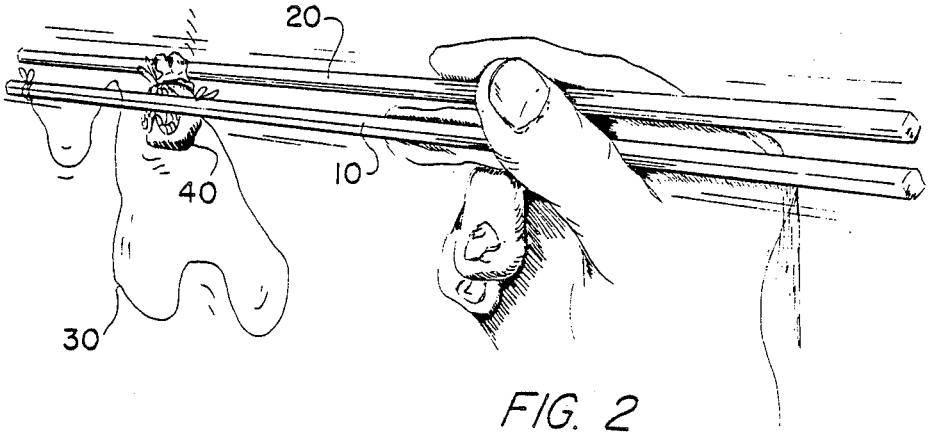
FIG. 2 is a perspective view of an amusement toy according to the present invention wherein the catch object is captured between the two elongated members.

As illustrated in FIGS. 1 and 2, a first elongated member 10 and a second elongated member 20 are provided and are adapted to be held by individual's fingers for manipulation. A catch object 40 is secured to a first end of said first elongated member 10 by securing means 30. The securing means 30 may be a string, or other flexible member for securing the catch object 40 at a predetermined distance from the first end of the first elongated member 10.

The elongated members 10, 20 may be rods, cylindrical objects, sticks, or any other members which are adapted to be held by an individual's fingers for manipulation. The catch object 40 may be in the shape of a conventional housefly. Further, other shapes of the catch object 40 are contemplated within the scope of the present invention.

IN OPERATION

In operation, the catch object 40 is swung about the first end of the first elongated member 10 by an individual. Simultaneously therewith, the individual's fingers manipulate the elongated members 10, 20 wherein the first ends thereof touch each other. By selectively manipulating the second ends of the elongated members 10, 20 and by touching the first ends of the elongated members 10, 20, an individual may capture the catch object 40 while in flight. In other words, as the catch object 40 swings about the first end of the first elongated member 10, the flight of the catch object 40 may be terminated by actually capturing the catch object 40 between the first ends of the elongated members 10, 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An amusement toy comprising:

a first elongated member having a first end and a second end, said second end being adapted to be held by an individual's fingers for manipulation;

a second elongated member having a first end and a second end, said second end being adapted to be held by an individual's fingers for manipulation;

said first and second elongated members are separate members, unattached to each other;

a catch object having a predetermined size; and securing means for securing said catch object at a predetermined distance from a first end of said first elongated member;

wherein swinging said catch object about said first end of said elongated member and manipulating said first and second elongated members to permit said first ends to touch each other enables an individual to selectively capture said catch object between said first ends of said first and second elongated members.

2. An amusement toy according to claim 1, wherein said securing member is a string for attaching said catch object to the first end of said first elongated member.

3. An amusement toy according to claim 1, wherein said catch object is shaped to resemble a fly.

4. An amusement toy according to claim 1, wherein said first and second elongated members are rods.

* * * * *